United States Patent [19]

Westfall

[11] 4,037,502

[45] July 26, 1977

[54] LOG POSITIONERS

[76] Inventor: Paul J. Westfall, 4444 W. Burnside, Portland, Oreg. 97210

[21] Appl. No.: 610,984

[22] Filed: Sept. 8, 1975

Related U.S. Application Data

[63] Continuation-in-part of Ser. No. 425,288, Dec. 17, 1973, Pat. No. 3,906,829, which is a continuation-in-part of Ser. No. 264,739, June 21, 1972, abandoned.

[51] Int. Cl.[2] ..... B27B 29/10

[52] U.S. Cl. ..... 83/726; 83/721; 83/723; 83/435.1; 83/425.4

[58] Field of Search ..... 83/726, 721, 723, 728, 83/722, 435.1, 425.4

[56] References Cited

U.S. PATENT DOCUMENTS

| | | | |
|---|---|---|---|
| 796,925 | 8/1905 | McDermott | 83/726 |
| 1,561,342 | 11/1925 | Martin | 83/723 |
| 1,786,261 | 12/1930 | Pelton | 83/726 |
| 3,128,803 | 4/1964 | Thrasher | 83/721 |
| 3,742,796 | 7/1973 | McMillan | 83/425.4 |

FOREIGN PATENT DOCUMENTS

| | | | |
|---|---|---|---|
| 563,416 | 9/1958 | Canada | 83/726 |

*Primary Examiner*—Donald R. Schran
*Attorney, Agent, or Firm*—Klarquist, Sparkman, Campbell, Leigh, Hall & Whinston

[57] ABSTRACT

A setworks in which a series of additively connected cylinder drives functions to locate a knee means for a desired cut on a log. A setworks in which a vernier adjusting mechanism precisely locates the knee means, which is held in position by an independent stopping means, and wherein while the knee means is so held the vernier mechanism is reset for subsequent full range operation.

5 Claims, 11 Drawing Figures

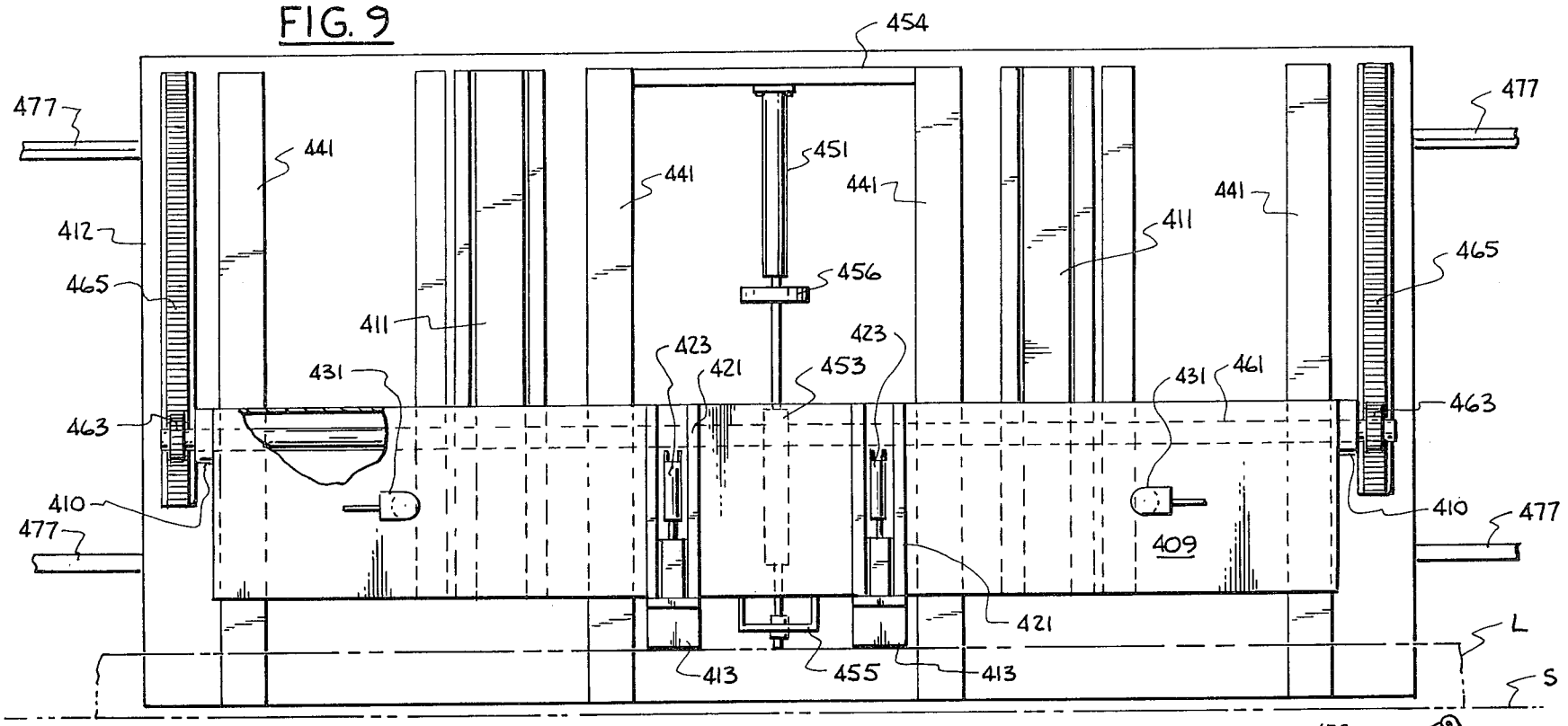
FIG. 9
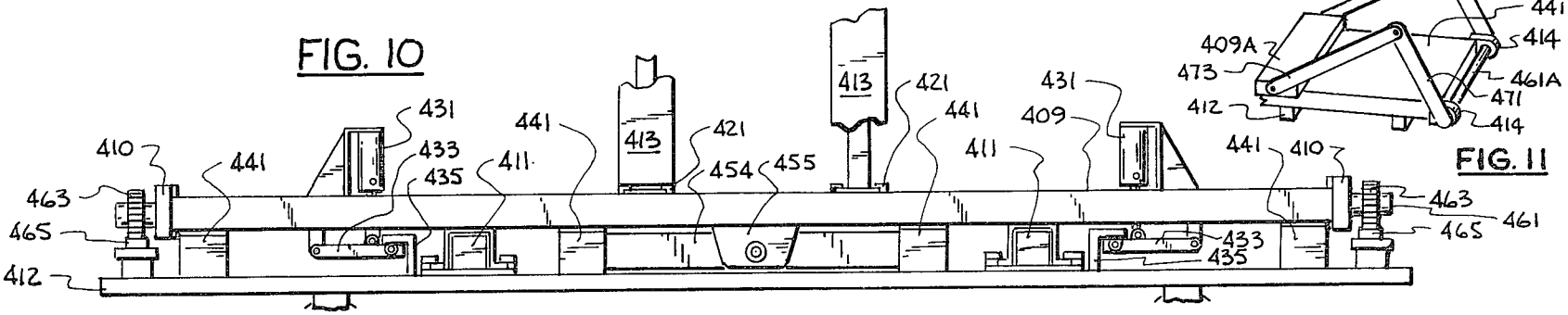
FIG. 11
FIG. 10

LOG POSITIONERS

PREVIOUS APPLICATIONS

This is a continuation-in-part application of my copending application, Ser. No. 425,288, filed Dec. 17, 1973, entitled IMPROVED LOG POSITIONERS now U.S. Pat. No. 3,906,829, granted Sept. 23, 1975 which, in turn, is a continuation-in-part of my prior application, Ser. No. 264,739, filed June 21, 1972, entitled IMPROVED LOG POSITIONERS, and now abandoned.

DESCRIPTION

This invention relates to improved log positioners, and more particularly to new and improved head rig log positioners.

An object of the invention is to provide new and improved log positioners.

Another object of the invention is to provide new and improved head rig log positioners.

A further object of the invention is to provide a new and improved feeler device for establishing the backstand of a log carriage.

Another object of the invention is to provide a feeler device movable by setworks.

Another object of the invention is to provide a non-creeping setworks for a head rig carriage.

Another important object of the invention is to provide a setworks having a vernier drive for a knee, and independent stopping means for holding the knee in fixed position until release of the stopping means, in combination with other means for resetting the vernier means while the knee means are so held.

Another object of the invention is to provide a log positioner in which a log holding knee is movable by cylinders with a clamp to hold the knee on the carriage to permit the cylinders to be reset without disturbing the setting of the knee.

Another object of the invention is to provide a log positioner including a knee movable across a carriage by a set of binary cylinders and a resetting cylinder in series with the set together with a first clamp for clamping the resetting cylinder to the carriage in selected extended conditions and a second clamp for clamping the knee to the carriage during a cut.

Another object of the invention is to provide a log positioner in which a boom carrying log holding knees is movable by a single line of cylinders and is kept in alignment by a torque tube.

In the drawings:

FIG. 9 is a fragmentary, top plan view of a log positioner forming an alternate embodiment of the invention;

FIG. 10 is a fragmentary elevation view of the positioner of FIG. 9; and, FIG. 11 is a fragmentary perspective view of a log positioner forming an alternate embodiment of the invention.

DETAILED DESCRIPTION

Figures 1, 3, 4, 5:
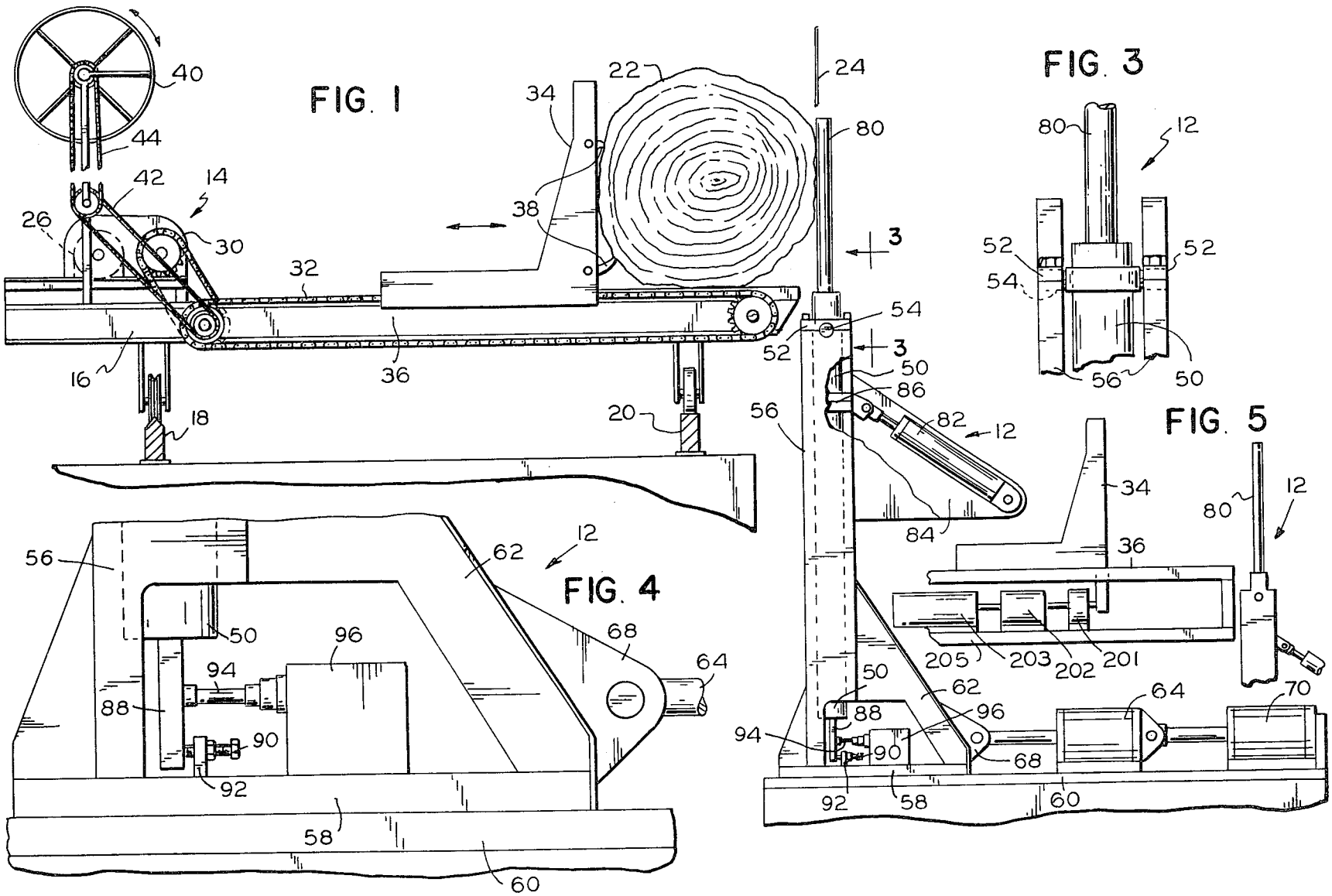
FIG. 1 is a fragmentary, vertical, sectional view of a head rig carriage and a positioner structure forming one embodiment of the invention.
FIG. 3 is an enlarged, fragmentary, elevation view taken along line 3—3 of FIG. 1.
FIG. 4 is an enlarged, fragmentary, elevation view taken along line 4—4 of FIG. 2.
FIG. 5 is a side elevation view of a preferred form of my invention.

Referring now in detail to the drawings, there is shown therein a head rig 10 (FIG. 1) including identical positioners 12 and 13 forming one embodiment of the invention. The head rig includes a known electromechanical setworks 14 on a carriage 16, which is movable along track rails 18 and 20 to move a log 22 to and past a saw band 24 to saw cants from the logs. The setworks 14 includes a reversible electric motor drive 26 (FIG. 2), which drives a line shaft 28 through reduction gearing 30. The line shaft drives chain-and-sprocket drives 32 to move knees 34 along transverse guides 36 of the carriage to move the log 32 laterally on the carriage. The knees 34 carry dogs 38 (FIG. 1), which hold the log against the knees. The line shaft also drives an indicator 40 through chain-and-sprocket drives 42 and 44 to give a visual indication of the position of the right-hand edge of the log.

In the drawings, the upper reach of the chain drive to the knee is shown as projecting above the upper face of the guide 36 for convenience in illustration. In practice, it is below such face so that the log rests on the guide, not the chain.

Figure 2:
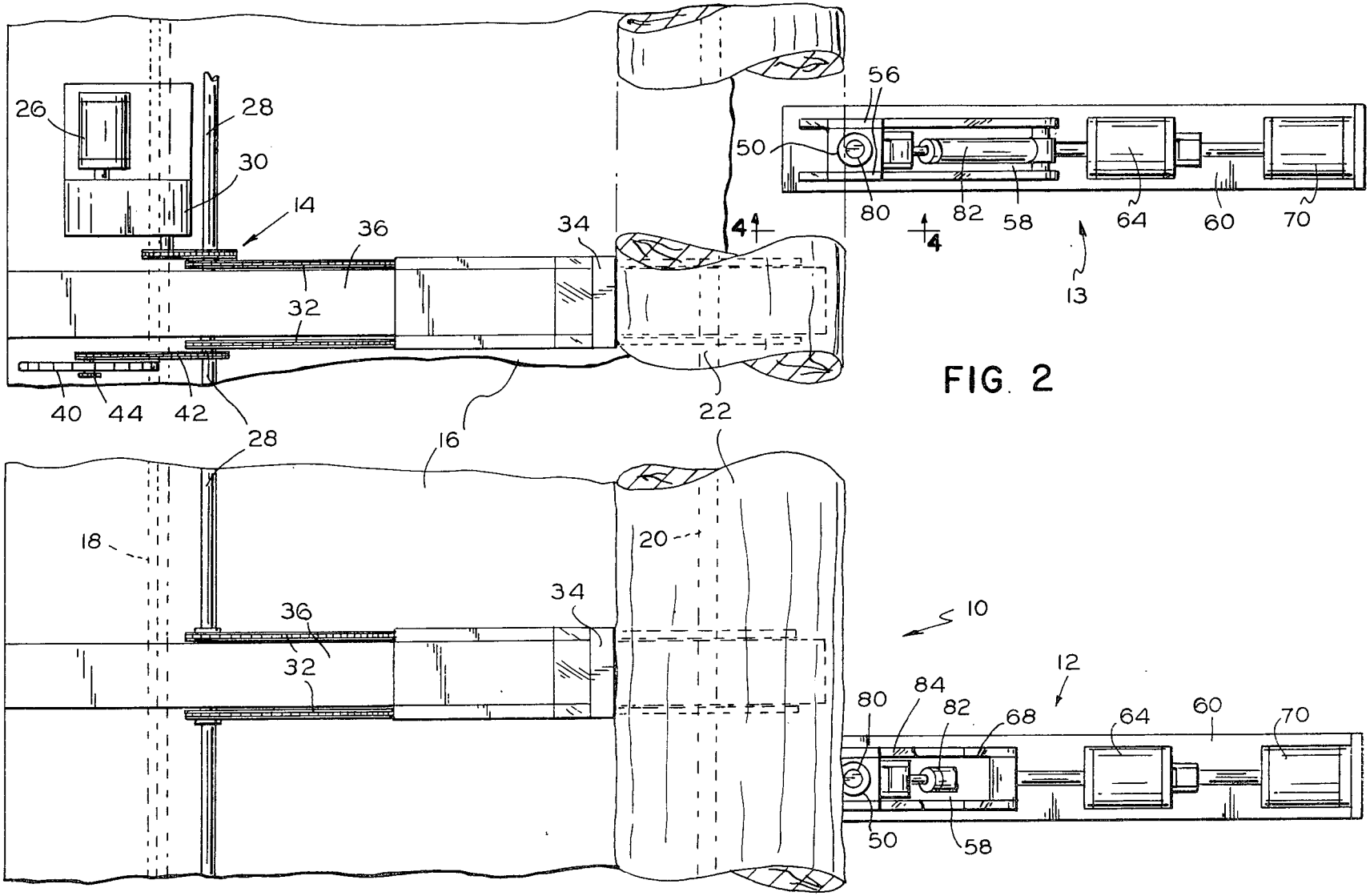
FIG. 2 is a fragmentary, top plan view of the carriage and the positioning structure of FIG. 1.

The positioners 12 and 13 very precisely position the log 22 at the zero position to calibrate the setworks 14, and also may be used to very precisely position the log for cutting cants. The positioner 12 includes a double-acting cylinder 50 pivotally mounted by bearings 52 and a trunnion 54 near the upper end of the cylinder. The bearings are mounted on uprights 56 on a slide 58 movable along a guideway 60 extending transversely of the track rails 18 and 20. The uprights are rigidly connected to a clevis 68 brazed to the brace 62 and also are connected to a fixed setworks unit 70. The two setworks units 64 and 70 are shown in FIG. 1 in their extended position, and each may be retracted individually under the control of the operator, it being understood that the positioner 13 is set identically with the setting of the positioner 12.

A piston rod 80 serves as a feeler, and is carried by the piston (not shown) in the cylinder 50. The cylinder 50 may be actuated to move the rod 80 to its extended position as shown in FIG. 1 and hold the rod in this position, and the cylinder 50 also may be actuated to retract the rod to a position below the top of the carriage. A single-acting cylinder unit 82 is connected between a bracket 84 fixed to the uprights 56 and a band 86 fixed to the cylinder 50. The cylinder unit 82 urges the cylinder 50 counter-clockwise, as viewed in FIG. 1, toward a vertical position in which a bar 88 on the lower end of the cylinder engaging a stop 90 in the form of an adjustment screw on a bracket 92. In this position, the bar 88 also engages a plunger 94 of a limit switch 96 mounted on the slide 58. When the log 22 reaches the desired position on the carriage, the log pushes the rod 80 to move the bar 88 away from the stop 90 just sufficiently to cause the switch 96 to be actuated. The switch 96 may be connected to the motor drive 26 to stop the motor drive 26 with the log precisely at the zero point, or the switch may be connected to a suitable indicator (not shown) to indicate to the operator when the log is at the zero point. When the cylinder unit 64 is retracted, positioner 12 or positioner 13 with the switch 96 and the corresponding switch of the positioner 13 connected in series to the motor drive, disconnects a clutch and applies a brake of the motor drive when the log is precisely in position for a cut of a predetermined thickness by the saw band 24. Similarly, when both the cylinder units 64 and 70 are retracted and the switch 96 and that of the positioner 13 are so connected to the motor drive, the positioner 12 or 13 stops the motor drive when the log is precisely in position for a cut of a greater predetermined thickness.

The switch 96 (and that of the positioner 13) is actuated by movement of its plunger of only a few thousandths of an inch, and the length of the lever arm formed by the point of contact of the log on the rod 80 to the trunnion 54 is a small fraction of the length of the lever arm from the trunnion to the plunger 94 of the switch 96, which amplifies the movement of the feeler rod by the log. Preferably, in setting the zero position, the switches of both the positioners 12 and 13 are connected in series to the motor drive 26 so that whichever positioner is actuated first by the log stops the carriage setworks.

EMBODIMENT OF FIG. 5

FIG. 5 shows a preferred embodiment of the invention in which the positioner 12 is bodily stationary, rather than being moved by cylinders 64 and 70, while each knee 34, instead of being driven by a motor 26, is driven by a series of "bottoming out" double-acting cylinders, three of which 201, 202 and 203, are shown. The cylinders are supported on a guide 205, which in turn is rigidly affixed to the associated guide 36. The cylinders vary in size (bottoming out movement) from, said 1/32 inches up to 16 or 32 inches in a geometric progression, so that any distance between 1/32 and 63 31/32 inches can be obtained to 1/32 of an inch. Controls (not shown) enable all or any combination of the cylinders to be energized. While the motor 26 is not used, the chain drive to the indicator 40 is retained.

In operation, the feeler 80 would be retracted to allow the log to be passed over it and against the knees to be clamped thereagainst. Now, the cylinders are energized to move the log out until the feeler is engaged, which breaks the circuits to the slenoid valves for the cylinders to hold them stationary, and lowers the feeler. This establishes a "zero" or backstand position for the log which is observed by the operator on the indicator 40.

The fluid is then selectively routed either manually or by an override logic circuit to the cylinders until the backstand position is attained to 1/32 of an inch with all cylinders bottomed out. Now, a cut is selected, and the fluid re-routed to obtain the desired cut with all cylinders bottomed out. For instance, assume that there is a 27½ inches backstand (distance from the knee face to the saw line). This would be obtained by bottoming out the following cylinders, 16 inches, 8 inches, 2 inches, 1 inch and ½ inch. Now to get a 4 inch cut, the 4 inches cylinder would be energized and bottomed out to move the log forwardly exactly four inches and hold it there without creep.

However, suppose that the backstand is 22 inches. This would be obtained by bottoming out the following cylinders: 16 inches, 4 inches and 2 inches. Now, to get a 4 inch cut with all cylinders bottomed out, the 4 inches cylinder would be contracted while the 8 inches cylinder is expanded — both bottomed out — to get an exact 4 inches cut without creep.

It is evident that while the cylinders could be manually controlled, a logic circuit would be much more desirable.

EMBODIMENT OF FIGS. 6-8

Figure 6:
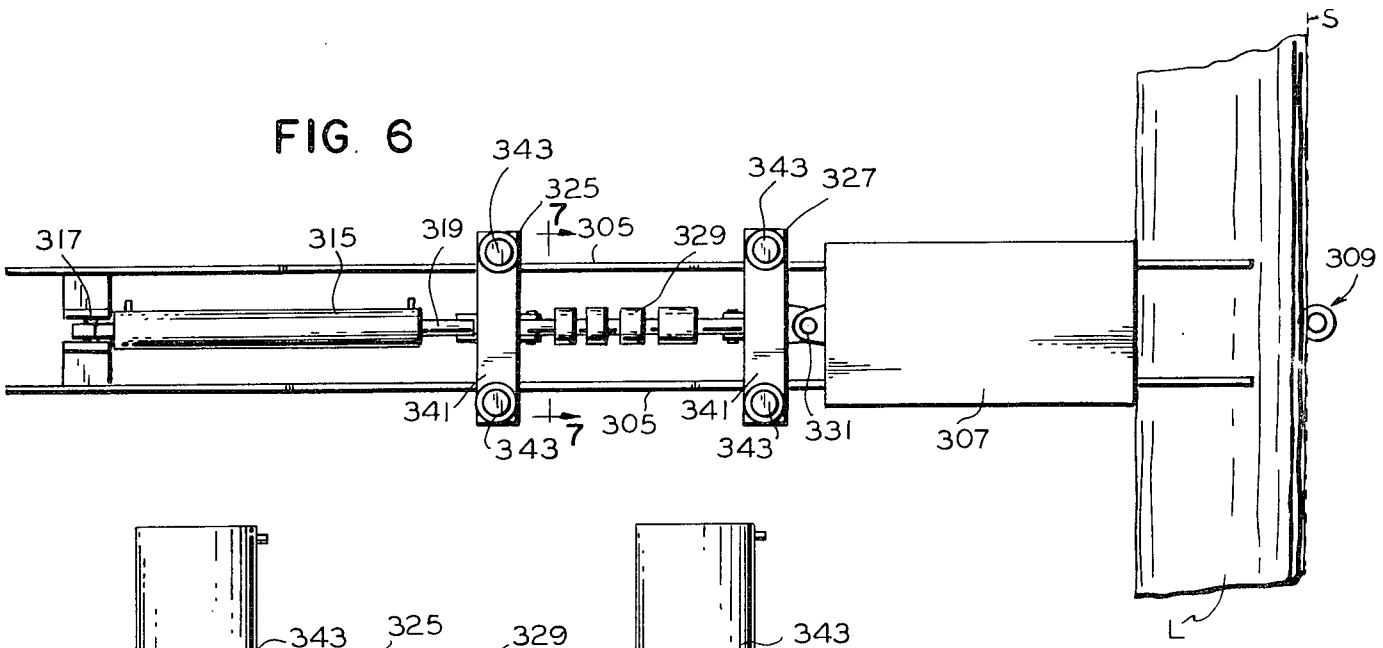
FIG. 6 is a plan view of a vernier type mechanism for adjusting the position of a knee.

Referring to FIG. 6, there is a pair of guides 305 for a knee 307, there being a pair of such knees for the log L. The knees carry the log L into contact with a gauge generally entitled 309, which is the like gauge in FIG. 5. The letter S indicates the saw line and thus the expected cut.

The knee 307 is actuacted by a cylinder arrangemet which includes a master or reset cylinder 315, and a vernier mechanism in the form of a series of binary cylinders 329. The master cylinder has its rear end anchored at 317 in stationary relation to the guides 305 of the carriage. The piston rod 319 of the cylinder 315 is in driving relation to the binary cylinders, there being a hydraulic clamp 325 interposed between the rod 319 and the rear end of the series of binary cylinders. The binary cylinders, in turn, are in driving relationship to the knee 307, there being a second hydraulic clamp 327 interposed between the head or front end of the series of binary cylinders and the knee means. The second hydraulic clamp is coupled at 331 to the knee 307. The hydraulic clamps are mounted in sliding or guided engagement with the guides 305, but when actuated clamp against the guides and hold certain elements in fixed position.

The binary cylinders 329 are like the cylinders 201, 202 and 203 in that the piston of one is connected to the cylinder of the next so that the movements of the pistons are additive.

Figure 7:
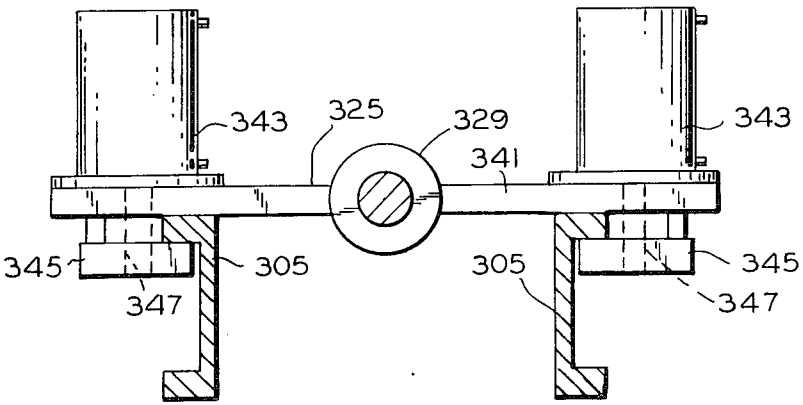
FIG. 7 is an enlarged sectional view taken along line 7—7 of FIG. 6.

FIG. 7 shows the construction of the hydraulic clamp 327. It includes a base member 341 slidably engaging the guides 305 and overhanging them. There is a hydraulic cylinder 343 at each end of the base member having an angle clamp lug 345 actuated by the piston rod 347.

When the clamp lugs 345 of the two ends of the base member are clamped upwardly, the whole clamp unit is held in a rigid, fixed relationship to the guides 305. When the clamp lugs are moved downwardly, the hydraulic clamps are released for movement along the guides 305. Clamp 325 is similar in construction to clamp 327.

Figure 8:
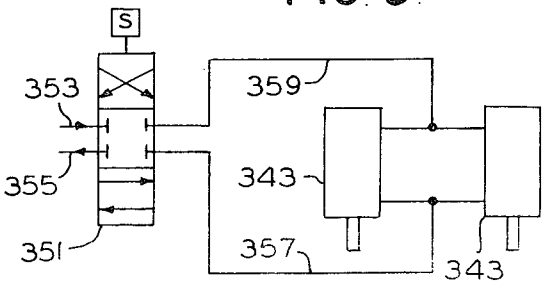
FIG. 8 is a schematic circuit diagram of certain of the stopping cylinders.

FIG. 8 shows the hydraulic circuit for the cylinders 343 of the hydraulic clamp 327. A similar circuit is provided for the hydraulic clamp 325. In FIG. 8, a pressure line 353 and a return line 355 are connected to one side of a solenoid operated reversing valve 351, whereas routing line 357 and 359 lead from the valve to the lower and upper portions of the cylinders 343, respectively. The reversing valve 351 can have a neutral position as shown and two operative positions. To activate the cylinders 343, the valve is shifted to supply fluid under pressure through the line 357. To inactivate the cylinders, the valve 351 is shifted to supply fluid under pressure to line 359.

In operation, assume that the double-acting binary cylinders 329 are collapsed and both hydraulic clamps are in released condition. The master cylinder 315 is energized to move the log L forwardly until it engages the gauge 309. Such engagement actuates the switch associated with the tilt gauge. This switch is electrically connected to the solenoid valve 351 of clamp 325, so as to shift the spool of the valve so as to supply fluid under pressure through the line 357 to actuate clamp 325. Thus, the clamp 325 is now held in rigid relation to the guides 305.

After the gauge rod has been lowered, the appropriate binary cylinder or cylinders are actuated to move the Log L beyond the saw line S the desired amount for the desired cut. Thereupon, the reversing valve for clamp 327 is actuated to energize the clamp to fixedly hold the knee 307 in the desired cutting position for the log L. Now, the carriage can be advanced along the saw line to pass the log through the saw.

While this is happening, clamp 325 is released and the master cylinder actuated to take up the movement of the binary cylinders so as to collapse them, whereafter the clamp 325 is again energized to set it. Thus, by the time that the log has returned to its FIG. 6 position (in spaced relation from the saw) the binary cylinders are in condition for resetting the log for the full range of movement available to the binary cylinders.

Now, leaving the clamp 325 activated, the clamp 327 is released and the appropriate binary cylinder or cylinders are activated to reposition the knee 307 and thus the log L for a second or subsequent cut of the log to a desired extent. Then the clamp 327 is again activated to hold the log fixed and to enable the carriage to be advanced to take the subsequent cut, during which the clamp 325 is again inactivated to reset the binary cylinders for subsequent full range operation.

An advantage of the FIG. 6 form of the invention is that the binary cylinders need only to have a combined travel equal to the greatest cut that is to be made. They do not have to have a combined travel equal to the entire range of movement of the knee. Another advantage of the FIG. 6 form of the invention is that it is unnecessary to rely upon the holding power of the binary cylinders. Instead, the hydraulic clamp 327 functions to rigidly hold the knee in a desired adjusted position. Thus, it is only necessary that the binary cylinders be used for adjustment, not holding purposes.

EMBODIMENT OF FIGS. 9 & 10

A log positioner forming an alternate embodiment of the invention and also shown in FIG. 11 includes only a single set of cylinders 451 and 453 to actuate the overall set works. (Both sets of knees 413 are actuated by the one set of cylinders.) There is a main beam 409 constrained by guides 411 on carriage 412 to move linearly back and forth toward and away from a saw line S so that the knees 413 mounted on the beam 409 will move a log L toward and away from the saw line. Each of the knees is mounted for sliding movement forwardly and rearwardly by guides 421 under the control of a cylinder 423. This is for taper adjustment. The main beam is releasably clamped and held in a fixed position by a pair of cylinder units 431 (FIG. 10) which actuate clamps 433 which engage holding rails 435. There are a set of four support rails 441 over which the main beam 409 moves, these guides or rail being to support the log directly rather than have the log supported by the guide rails 411 in the interim during loading of the log on the carriage in which the log is being trundled over the rails and toward the knees 413.

The main beam 409 is moved back and forth to attain a desired position of the knees 413 and log with respect to the saw line S by a single series or set of cylinders consisting of a master cylinder 451 and the single set of binary or geometric cylinders 453. The cylinders 453 are like the cylinders 329, shown in FIG. 6, and the cylinder 451 corresponds to the cylinder 315 of FIG. 6. The binary cylinders 453 are anchored by a rigid bracket 455 to the beam 409. The cylinder 451 is anchored to a crossbar 454 which is fixed rigidly to certain to the rails 441. A hydraulic clamp 456 is provided to clamp the piston of the cylinder 451 against movement relative to the carriage when the cylinder 451 is extended to the desired extent. When the clamp 456 is actuated, the set of cylinders 453 may be actuated to move the beam to a desired position, the clamps 431 being released at this time, of course. Then, to make a cut, the clamps 431 are actuated to lock the beam to the carriage. Then the clamp 456 is released and the cylinders 453 are collapsed and the cylinder 451 extended and then the clamp 456 is again placed in clamping position.

To maintain alignment of the beam 409, a torque tube 461 is provided and extends through the hollow main beam 409 and is journaled therein by bearings 410, and is equipped at its outer end with spur gears 463 which ride on stationary racks 465 fixed to the carriage 412. Thus, the spur gears and racks maintain a desired alignment of the beam 409 at all times despite the fact that the beam is actauted by only the single series of cylinders 451 and 453. The carriage is movable along rails 477.

OPERATION

The operation of the form of the invention disclosed in FIGS. 9 and 10 is the same as described in FIG. 6 except that in FIGS. 9 and 10, the actuation of both of the knees 413 is by a single series or set of cylinders, while in FIG. 6, each knee 307 is operated by its own set of cylinders. In any event, after the log is mounted on the knees 413 and clamped in place by dogs (not shown), the cylinder 451 is actuated to bring the log in contact with one or more sensors which can be like sensors 309 in FIG. 6, but can be any other form of sensor, to locate the leading edge of the log parallel with and at the saw line S.

Thereafter, with the clamp 456 clamping, the desired depth of cut can be set by actuating the appropriate binary cylinders 453 while maintaining the piston of the cylinder 451 in a fixed position. Thereafter, the clamps 431 are actuated to hold the main beam 409 in the set position. Then, while the cut is being taken, the clamp 456 is released and cylinders 453 are fully collapsed, with the cylinder 451 being allowed to move sympathetically. Then the clamp 456 is again placed in clamping condition, and, after the cut has been made and the log has cleared the saw, the clamps 431 are released and the appropriate cylinders 453 are extended to make the next set, after which the clamps 431 are again placed in clamping condition and the clamp 456 is released and the cylinder 451 extended and the cylinders 453 all collapsed.

EMBODIMENT OF FIG. 11

A preferred form of the invention, which is like that of FIGS. 9 and 10 except that the desired alignment of a main beam 409A on carriage 412 is maintained by a torque tube 461A through the medium of two pairs of levers, each pair including a first rigid lever 471 pivotally connected at one end to the torque tube 461A and a second rigid lever 473 which is pivotally connected at one of its ends to the lever 471 and to its other end to the beam 409A. The torque tube is journaled on a fixed axis on the carriage by bearings 414. The torque tube and levers insure maintaining desired alignment of the main beam 409A The operating of the positioner of FIG. 11 is the same as that of FIGS. 9 and 10 except that the main bam 409A is kept parallel by the torque tube 461A and the levers 471 and 473.

What is claimed is:

1. An actuating assembly for a head rig having a log carriage and knee means movable along the carriage to variously locate a log relative to a saw, comprising setwork means on the carriage including a series of bottoming out cylinder drives having varying effective lengths, the piston of each cylinder drive being connected to the cylinder of the adjacent cylinder drive whereby the movement of each piston is additive to the movement of each of the other pistons, means for energizing the cylinder drives selectively to differently locate the knee means and thereby the log with relation to the saw, said series of cylinders having a head end in driving relation to said knee means, first stopping means associated with said knee means, second stopping means associated with the rear end of said series of cylinder drives, control means whereby the first stopping means may be activated after a selected position of said knee means has been achieved to fixedly hold said knee means in said position until such time as said first stopping means has been inactivated, said control means inactivating said second stopping means while said first stopping means is activated to enable collapsing movement of said series of cylinders without distrubing the position of said knee means, said means connected to the rear ends of said series of cylinders for collapsing the same to condition the same for full extension when the second stopping means is subsequently activated and said first stopping means is activated.

2. In a head rig, a carriage movable parallel to a sawline, a beam, guide means mounting the beam on the carriage for movement transversely of the sawline, a plurality of knees mounted on the beam for holding a log, a single line for moving means for moving the beam along the guide means, alignment maintaining means for preventing cocking of the beam relative to the guide means, said alignment maintaining means comprising a torque tube, means mounting the torque tube rotatably on the carriage, a pair of first arms keyed to the torque tube in parallel positions, and a pair of second arms connected pivotally to the beam and pivotally to the first pair of arms.

3. The head rig of claim 2 including a cross shaft keyed to the second pair of arms and pivotally connecting the second pair of arms to the first pair of arms.

4. An actuating mechanism for actuating a knee along a carriage in a setworks, said mechanism including a set of binary cylinders having a head end with means for operatively connecting it to said knee, said mechanism having a tail end, a reset actuator having an effective travel at least as long as the effective length of said binary cylinder set and having means for connecting said actuator to the tail end of said binary cylinder set, means for selectively anchoring the tail end of said binary set to facilitate adjustment of the position of said knee by selective extension of said binary set, means for selectively energizing the cylinders of said binary set to selectively adjust the position of said knee, and means for selectivey anchoring the head end of said binary set to facilitate collapsing of said set by the action of said actuator when the tail end of said binary set is released.

5. An actuating mechanism as recited in claim 4 in which said actuator comprises a single master hydraulic cylinder having a head end operatively connected to the tail end of said binary cylinder set, and means on the tail end of said master cylinder for anchoring it to the carriage.

* * * * *

UNITED STATES PATENT OFFICE

CERTIFICATE OF CORRECTION

PATENT NO. : 4,037,502

DATED : July 26, 1977

INVENTOR(S) : Paul J. Westfall

It is certified that error appears in the above-identified patent and that said Letters Patent are hereby corrected as shown below:

Column 2, line 22, --32-- should be 22.
Column 3, line 38, --said-- should be "say".
Column 3, line 48, --slenoid-- should be "solenoid".
Column 4, line 12, --the like-- should be "like the".
Column 4, line 15, --actuacted--should be "actuated".
Column 5, line 59, --rail-- should be "rails".
Column 6, line 5, --certain to-- should be "certain of".
Column 6, line 21, --end-- should be "ends".
Column 6, line 25, --actauted-- should be "actuated".
Column 6, line 39, --sensors-- should be "sensor".
Column 7, line 5, --bam-- should be "beam".
Column 7, line 37 (Claim 1), --said-- should be "and".
Column 7, line 41 (Claim 1), --activated-- should be "inactivated
Column 8, line 5 (Claim 2), --line for-- should be "line of".
Column 8, line 34 (Claim 4) --selectivey-- should be "selectively Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*